US010473283B2

(12) United States Patent
Ho

(10) Patent No.: US 10,473,283 B2
(45) **Date of Patent: *Nov. 12, 2019**

(54) STRUCTURE OF A LIGHTING DISPLAY DEVICE

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/161,433

(22) Filed: Oct. 16, 2018

(65) Prior Publication Data

US 2019/0049082 A1 Feb. 14, 2019

Related U.S. Application Data

(63) Continuation-in-part of application No. 15/180,400, filed on Jun. 13, 2016, now Pat. No. 10,168,027.

(30) Foreign Application Priority Data

Mar. 25, 2016 (TW) ..... 105204175 U

(51) Int. Cl.

| | |
|---|---|
| ***F21S 10/00*** | (2006.01) |
| ***F21S 6/00*** | (2006.01) |
| ***F21V 19/00*** | (2006.01) |
| ***F21V 19/04*** | (2006.01) |
| *F21Y 115/10* | (2016.01) |

(52) U.S. Cl.
CPC ..... *F21S 10/002* (2013.01); *F21S 6/002* (2013.01); *F21V 19/00* (2013.01); *F21V 19/04* (2013.01); *F21Y 2115/10* (2016.08)

(58) Field of Classification Search
CPC .. G09F 13/24; F21V 17/08–10; F21S 10/002; F21S 6/002
See application file for complete search history.

(56) References Cited

U.S. PATENT DOCUMENTS

2017/0051888 A1* 2/2017 Kehrmann ..... F21S 10/002

* cited by examiner

*Primary Examiner* — Julie A Bannan
(74) *Attorney, Agent, or Firm* — Rosenberg, Klein & Lee

(57) ABSTRACT

An improved structure of a lighting display device includes a lower fixing element, an upper fixing element, a projection device, a transparent bottle, and an assembling element. The projection device is disposed inside the lower fixing element and the transparent bottle is disposed thereon and fixed by a positioning annulus on an inner surface of the lower fixing element. The assembling element has an upper engaging space to be mounted on the transparent bottle and a top surface for a depression surface under a positioning plate of the upper fixing element to be engaged and fixed thereon. A spring is further disposed between the upper engaging space and the transparent bottle. Thereby the transparent bottle is able to display attractive visual effects by lighting projection and to be easily engaged and disengaged.

8 Claims, 11 Drawing Sheets

STRUCTURE OF A LIGHTING DISPLAY DEVICE

This patent application is a continuation-in-part of Ser. No. 15/180,400 filed on Jun. 13, 2016.

BACKGROUND OF THE INVENTION

1. Field of the Invention

The present invention relates to an improved structure of a lighting display device, particularly to one that displays attractive visual effects by lighting projection and one that has a structure for easy engagement and disengagement.

2. Description of the Related Art

Lava lamps have been common lighting fixtures in bedrooms since 1960s. In some countries they are even embedded in the mainstream cultures already. As further developed, now there are liquid motion lamps and bubble lamps. A liquid motion lamp holder improvement disclosed in U.S. Pat. No. 9,091,405 is illustrated in FIGS. 1A and 1B. The invention mainly includes base 111, a first mounted seat 112 with a first contacting room 1121, a second mounted seat 113 with a second contacting room 1131, a support bracket 114 linking the first and second mounted seats 112, 113, a transparent bottle 140 with fillers to be mounted between the first and second mounted seats 112, 113, and a joint sleeve 120 engaged a lower end of the transparent bottle 140. The second mounted seat 113 further has a second lamp seat 1132 with a LED bulb 132 thereon and a lampshade 115. The invention has the LED bulb 132 projecting lights to display visual effects by the transparent bottle 140. On the other hand, the second contacting room 1131 also allows the transparent bottle 140 to be moved vertically within the space for easy engagement and disengagement.

To disengage the transparent bottle 140, the joint sleeve 120 and the transparent bottle 140 have to be displaced upwards for an upper end 142 of the transparent bottle 140 to move deep into the second contacting room 1131 of the second mounted seat 113 and for the joint sleeve 120 to disengage from the first contacting room 1121 of the first mounted seat 112. Then remove the joint sleeve 120 from a lower end of the transparent bottle 140 for which to disengage from the first and second mounted seats 112, 113. When installing the transparent bottle 140, simply follow the procedure reversely.

Such design has the second mounted seat 113 to have a much longer diameter than the one of the transparent bottle 140 so that the transparent bottle 140 can slant for disengagement. Therefore, there is a gap between the transparent bottle 140 and the second mounted seat 113 that may cause overturning and falling of the transparent bottle 140. Also, to engage the joint sleeve 120 together with the transparent bottle 140, a height h2 of the second mounted seat 113 has to be much higher than a height of the joint sleeve 120. Such restriction results in a waste in space and prime cost as well. Such structures can also be seen with different applications and designs in U.S. Pat. Nos. 8,746,913 and 8,960,939 disclosed by the inventor.

In short, the inventor strives to improve the defects disclosed above—to lower the unnecessary height of the support and to reduce the prime cost for manufacturing.

SUMMARY OF THE INVENTION

A primary object of the present invention is to provide a lamp holder structure that is easily assembled and disengaged for its users to conveniently replace a transparent bottle thereof and a projection bulb thereof by themselves.

Another object of the present invention is to provide an improved structure of a lighting display device that ensures stability and safety of the transparent bottle.

Also, the present invention aims to provide an improved structure of a lighting display device that can reduce spaces needed for replacement of the transparent bottle, so as to reduce the prime cost as well.

To achieve the objects mentioned above, the present invention comprises a frame body including a base at a bottom thereof, a stand connecting the base with a lower end thereof, an upper fixing element connecting with an upper end of the stand along an axis perpendicular to a center of the base and having a positioning plate, the positioning plate including a peripheral wall extending downwards to form a depression surface and an engaging section fixed at a center thereof, and a lower fixing element fixed on the base, defining a lower engaging space therein with a positioning annulus arranged on an inner surface thereof; a projection device disposed within the lower engaging space; a transparent bottle engaging the positioning annulus;

wherein an assembling element is mounted on the transparent bottle, having an upper engaging space therein and a top surface thereof engaging said depression surface of the positioning plate, the top surface having a positioning hole at a center thereof to engage the engaging section of the positioning plate for a stronger engagement therebetween; and wherein a spring is disposed inside the upper engaging space, abutting between the top surface of the assembling element and the transparent bottle for the transparent bottle to be positioned along the axis perpendicular to the base and for the top surface of the assembling element to fixedly engage the depression surface of the positioning plate;

whereby the transparent bottle would produce attractive visual effects by the projection device, and the spring allows the transparent bottle together with the assembling element to be easily engaged and disengaged from the upper and lower fixing elements.

With the features disclosed above, the top surface of the assembling element is either a flat surface or a concave surface. The positioning plate is detachable from the engaging section and includes a through hole at a center thereof, and the engaging section is extended from a bottom of the upper fixing element with threads formed on a periphery thereof for engaging through the through hole of the positioning plate and fixed under the bottom of the upper fixing element by a nut. A washer is further disposed between the nut and the positioning plate.

Advantageously, the positioning plate of the upper fixing element further has an engaging section fixed at a center thereof, and the depression surface of the assembling element further has a positioning hole at a center thereof to engage the engaging section of the positioning plate for stronger engagement.

Furthermore, a bumper pad is disposed between the transparent bottle and the positioning annulus of the lower fixing element. The projection device includes a first bulb holder fixedly disposed in the lower engaging space of the lower fixing element and a bulb engaging on the first bulb holder for lighting and projection, and the present invention may include a second bulb holder and a lampshade disposed on the stand, and the second bulb holder engages a lighting bulb in an embodiment.

With the disclosed structures, the present invention has the spring to abut between the assembling element and the upper fixing element, so that it can contract for the assembling element to be easily disengaged from the upper fixing element, thus removing the transparent bottle without a great effort. Therefore, it is convenient for its users to replace the transparent bottle or even the bulb thereunder. Also, with such structure, the space needed for the transparent bottle to slant for disengagement is little, further ensuring stability and safety of the present invention; besides, with such a simple structure, the present invention does not need to comply with a restriction of heights and space in the manufacturing process, therefore reduces the prime cost.

DETAILED DESCRIPTION OF THE PREFERRED EMBODIMENT

Figure 1A:
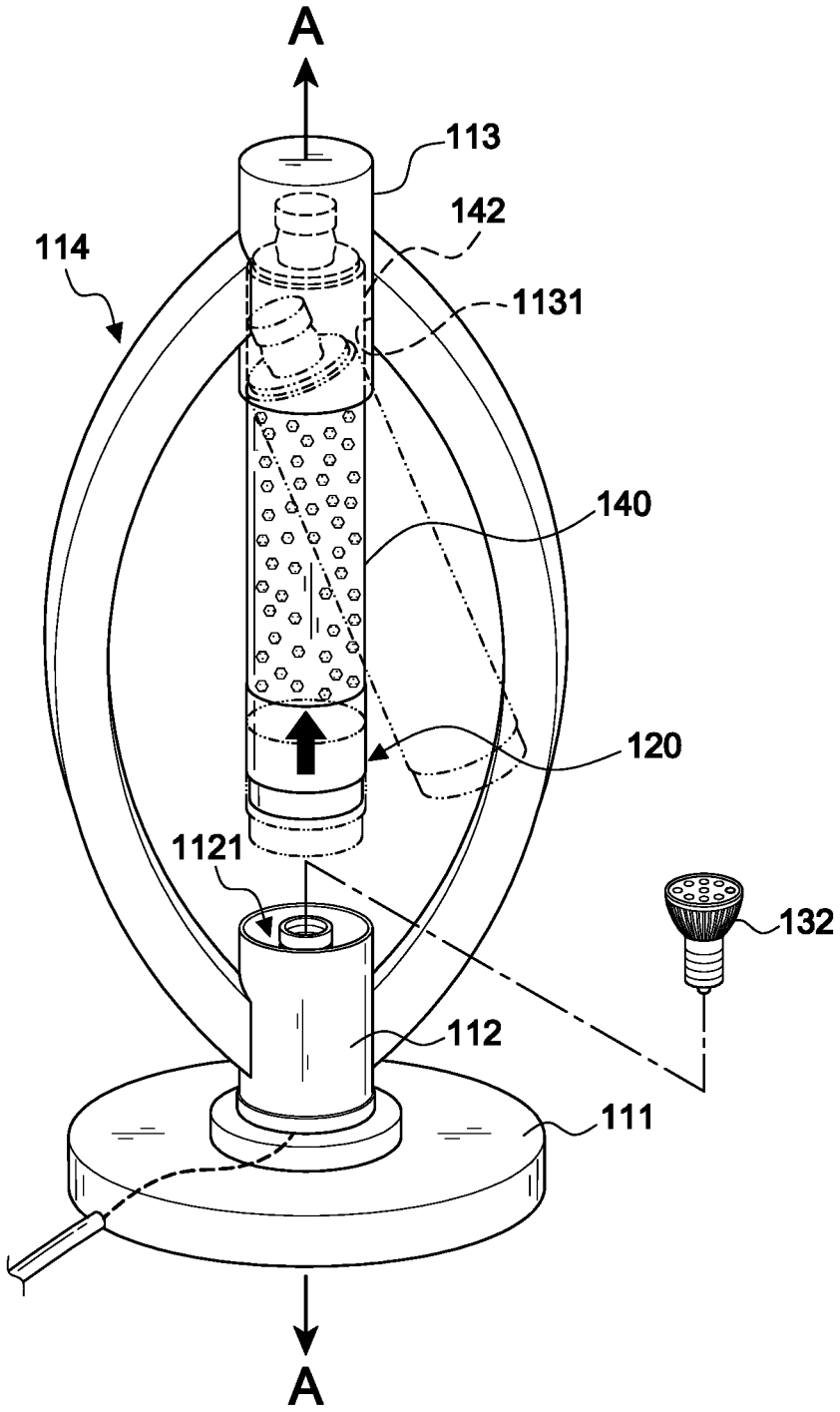
FIG.1A PRIOR ART
FIG. 1A is a conventional liquid motion lamp with an improved holding structure.
Figure 1B:
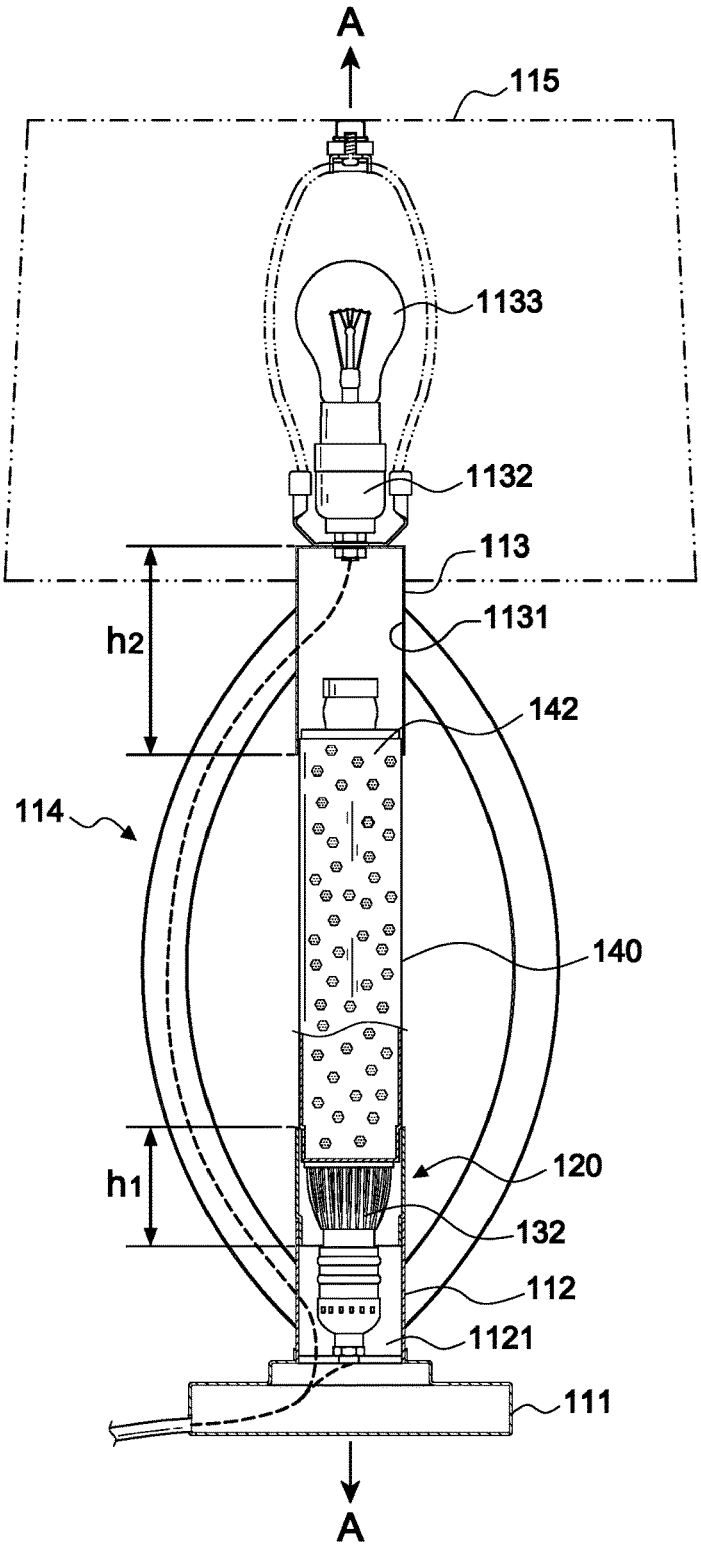
FIG.1B PRIOR ART
FIG. 1B is a schematic diagram of the liquid motion lamp in FIG. 1A integrated with a lighting structure.
Figure 2:
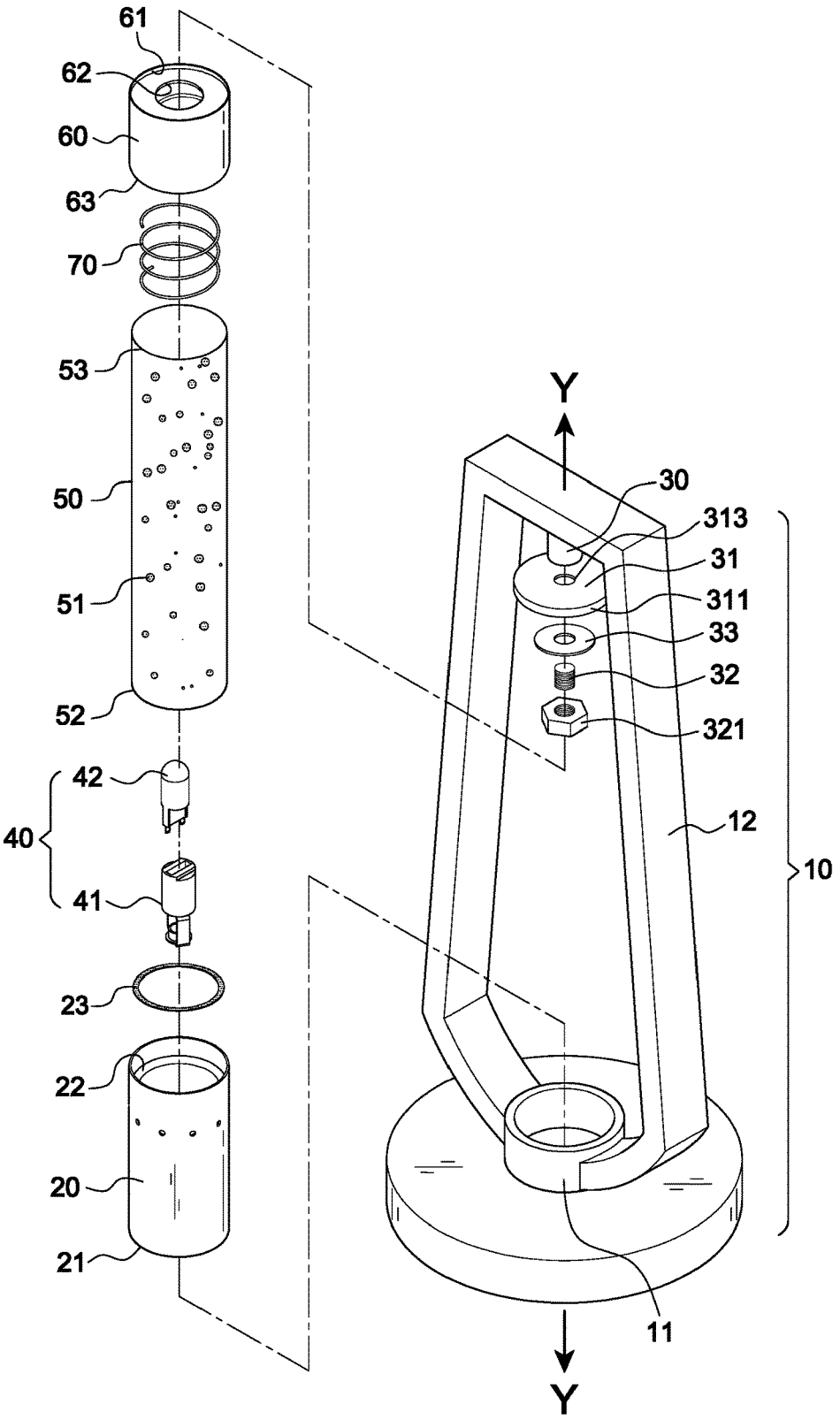
FIG. 2 is an exploded view of the present invention in a preferred embodiment.

A preferred embodiment of the present invention is illustrated in FIGS. 2-8. In the embodiment, the present invention mainly comprises a frame body 10, a projection device 40, a transparent bottle 50, an assembling element 60, and a spring 70.

The frame body 10 includes a base 11 arranged at a bottom thereof, an upper fixing element 30 arranged at an upper section thereof, a stand 12, and a lower fixing element 20 arranged at a lower section thereof. The upper fixing element 30 has a positioning plate 31 arranged below which includes a peripheral wall 311 extending downwards to form a depression surface 361 and has an engaging section 32 fixed at a center thereof. The stand 12 connects the base 11 with a lower end thereof and connects the upper fixing element 30 with an upper end thereof for the upper fixing element 30 to be disposed along an axis Y-Y perpendicular to a center of the base 11. The lower fixing element 20 is fixed on the base 11, defining a lower engaging space 21 therein with a positioning annulus 22 arranged on an inner surface thereof; a bumper pad 23 is further disposed on the positioning annulus 22.

The projection device 40 is disposed within the lower engaging space 20. In this embodiment, the projection device 40 includes a first bulb holder 41 fixedly disposed in the lower engaging space 20 and a bulb 42 engaging on the first bulb holder 41 for lighting and projection; the bulb 42 can be a LED bulb as well.

The transparent bottle 50 has a bottom end 52 engaging the positioning annulus 22 and the bumper pad 23 with fillers 51 therein. The fillers 51 can be made of a liquid for the transparent bottle 50 to be a liquid motion lamp; or the fillers can be made of two different liquids for the transparent bottle 50 to be a lava lamp. In this embodiment, the transparent bottle 50 is a LED bubble lamp.

The assembling element 60 is mounted on a top end 53 of the transparent bottle 50 and has an upper engaging space 63 therein and a top surface 61 arranged atop. The top surface 61 is further engaged with the depression surface 361 of the positioning plate 31 and has a positioning hole 62 at a center thereof for the engaging section 32 of the positioning plate 31 to engage through, thus enhancing the engagement of the assembling element 60 and the upper fixing element 30.

The positioning plate 31 is detachable from the engaging section 32 and includes a through hole 313 at a center thereof, and the engaging section 32 is extended from a bottom of the upper fixing element 30 with threads formed on a periphery thereof for engaging through the through hole 313 of the positioning plate 31 and fixed under the bottom of the upper fixing element 30 by a nut 321. A washer 33 is further disposed between the nut 321 and the positioning plate 31.

Figure 6:
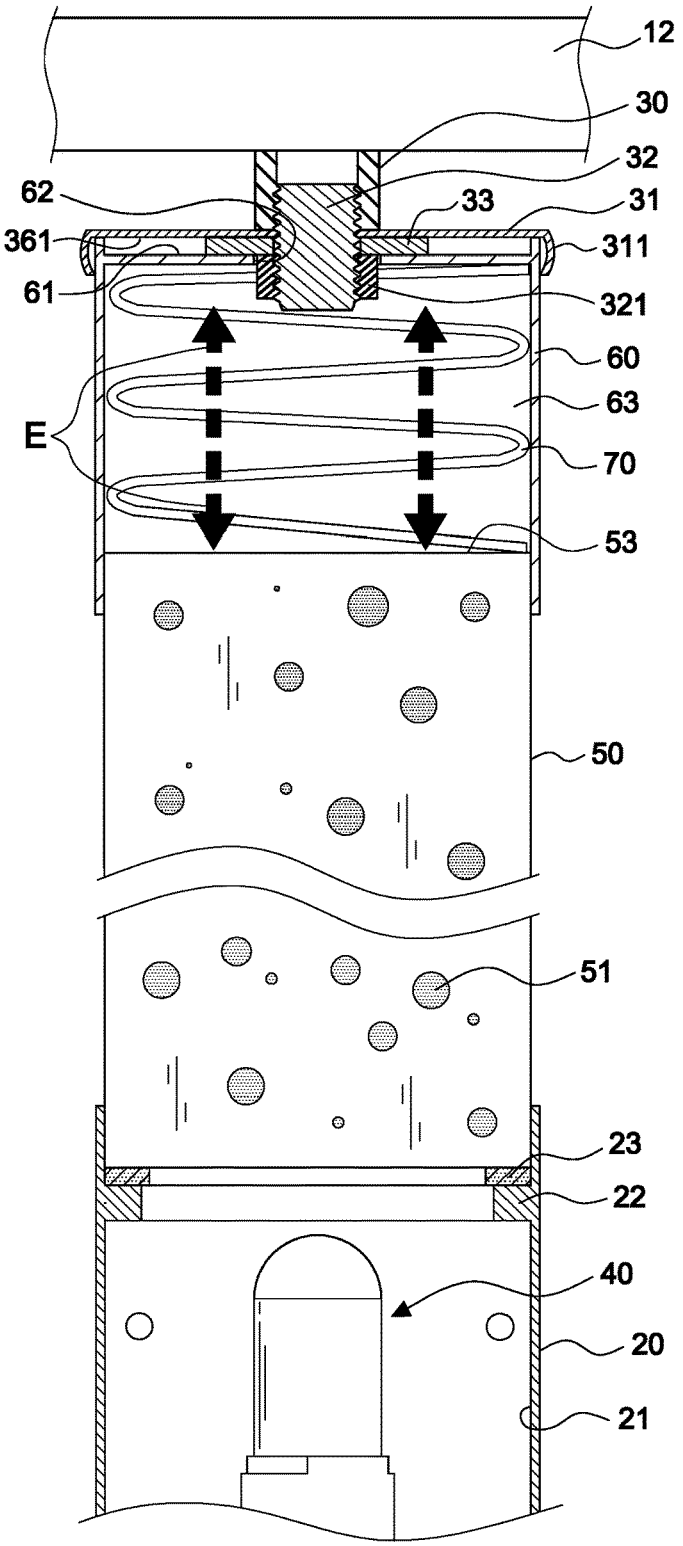
FIG. 6 is a sectional view of a major structure of the present invention.
Figure 6A:
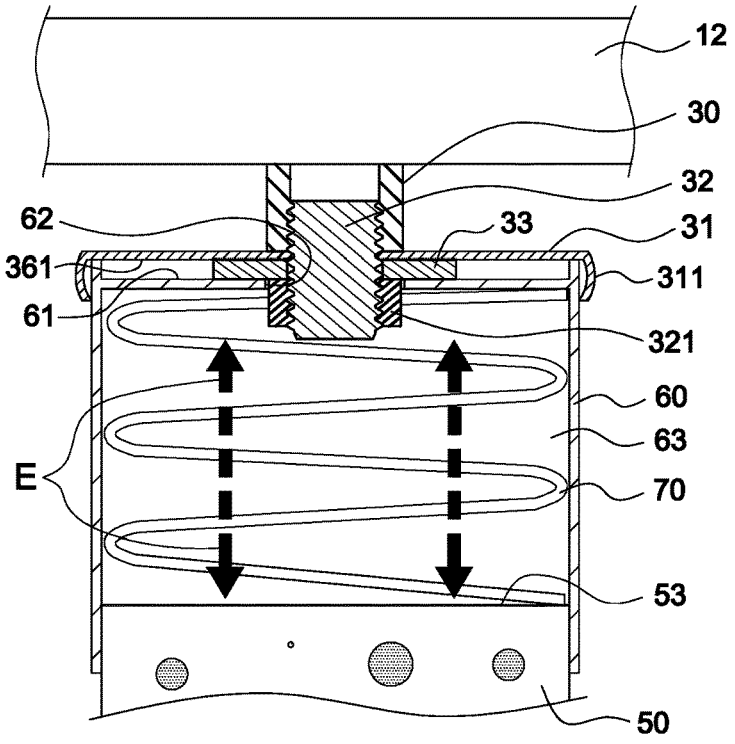
FIG. 6A is a partially enlarged view of FIG. 6.
Figure 6B:
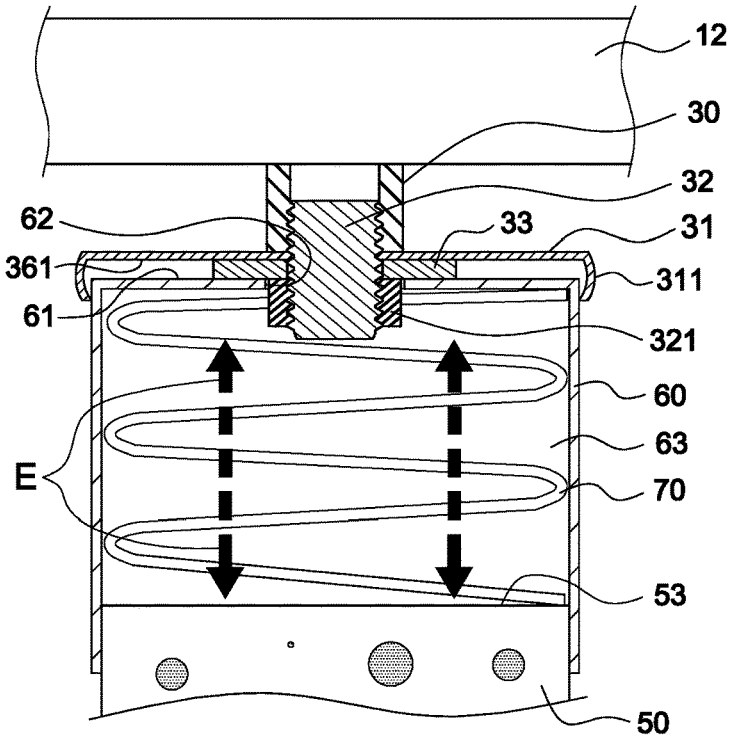
FIG. 6B is a partially enlarged sectional view of the major structure of the present invention in another embodiment.

The feature of the present invention is further illustrated in FIGS. 6A and 6B. The depression surface 361 is formed by having the peripheral wall 311 at the bottom of the positioning plate 31 extending downwards for the positioning plate 31 to be mounted on the top surface 61 of the assembling element 60, and the positioning plate 31 is fixedly engaged with the assembling element 60 by having the engaging section 32 engaging through the positioning hole 62 for stronger engagement. Also, with the design of the peripheral wall 311, the positioning plate 31 is able to be fixedly mounted on the assembling element 60 as well. On the other hand, the positioning plate 31 being detachable from the engaging section 32 further enables more options of the positioning plate 31 in the manufacturing process in accordance with a diameter of the transparent bottle 50, making the present invention more applicable in the field. And the top surface 61 of the assembling element 60 can be either a concave surface as shown in FIG. 6A or a flat surface as shown in FIG. 6B.

Figure 5:
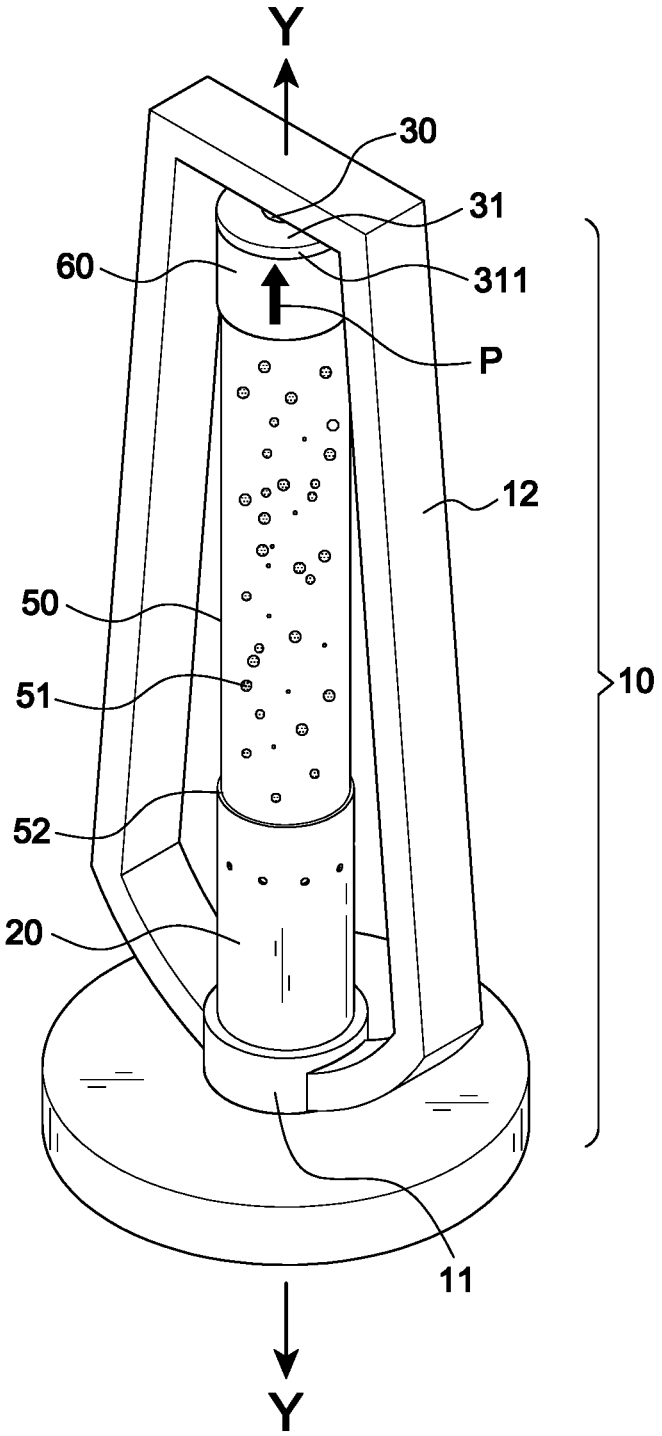
FIG. 5 is a perspective view of FIG. 2.

The spring 70 is disposed inside the upper engaging space 63, abutting between the top surface 61 of the assembling element 60 and the transparent bottle 50 for the transparent bottle 50 to be positioned along the axis Y-Y perpendicular to the base 11 and for the top surface 61 to fixedly engage the depression surface 361 of the positioning plate 31 as shown in FIGS. 5 and 6.

Figure 3:
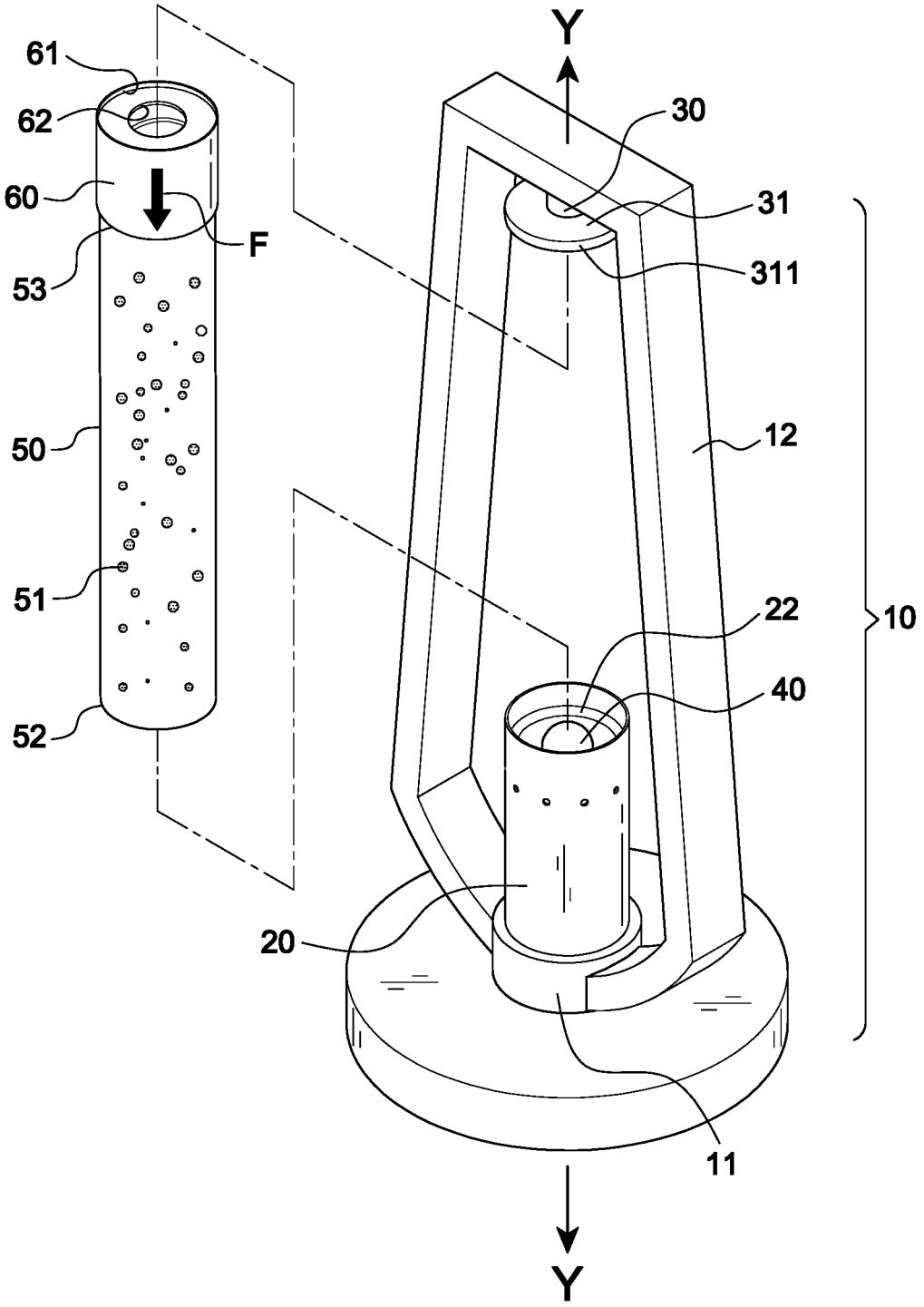
FIG. 3 is a perspective view illustrating a partially assembled structure of FIG. 2.
Figure 4:
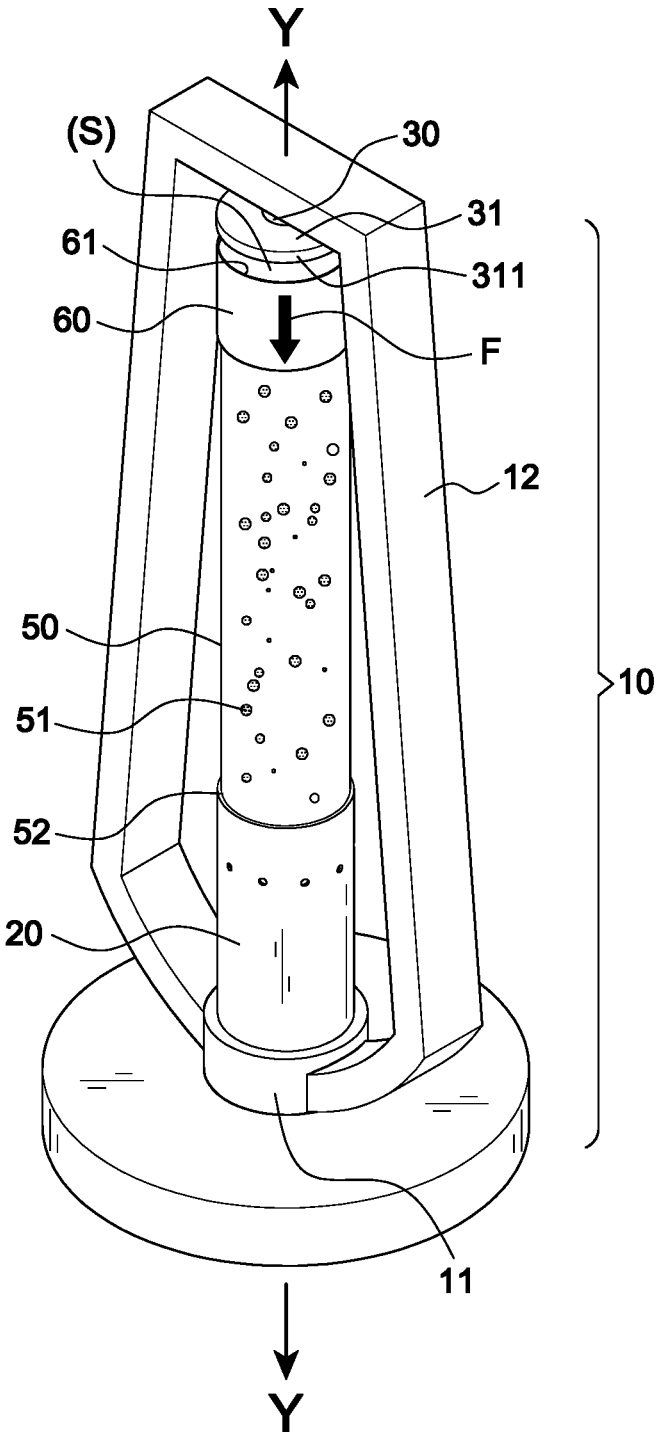
FIG. 4 is a perspective view of FIG. 2 illustrating a transparent bottle thereof being disposed in a lower fixing element thereof.

Referring to FIGS. 3-5, when disposing the transparent bottle 50 on to the frame body 10, the spring 70 has to be disposed in the upper engaging space 63 of the assembling element 60 before the assembling element 60 is mounted on the top end 53 of the transparent bottle 50. Then pressing the assembling element 60 downwards F so that the transparent bottle 50 can slightly slant to be positioned by having the bottom end 52 engaging the lower fixing element 20 and mounted on the positioning annulus 22 and bumper pad 23, and a gap S is formed between the top surface 61 and the peripheral wall 311 of the positioning plate 31. After positioning the transparent bottle 50, pulling the assembling element 60 upwards P for the engaging section 32 at the center of the positioning plate 31 to engage through the positioning hole 62 of the top surface 61 and disposing the transparent bottle 50 along the axis Y-Y perpendicular to the base 11. The spring 70 in the upper engaging space 63 has elasticity E to abut the top surface 61 from under and to abut the top end 53 of the transparent bottle 50 for fixed placement of the transparent bottle 50 between the upper and lower fixing elements 30, 20. With structure of the projection device 40, the transparent bottle 50 would display attractive visual effects together with the fillers 51 therein.

Figure 7:
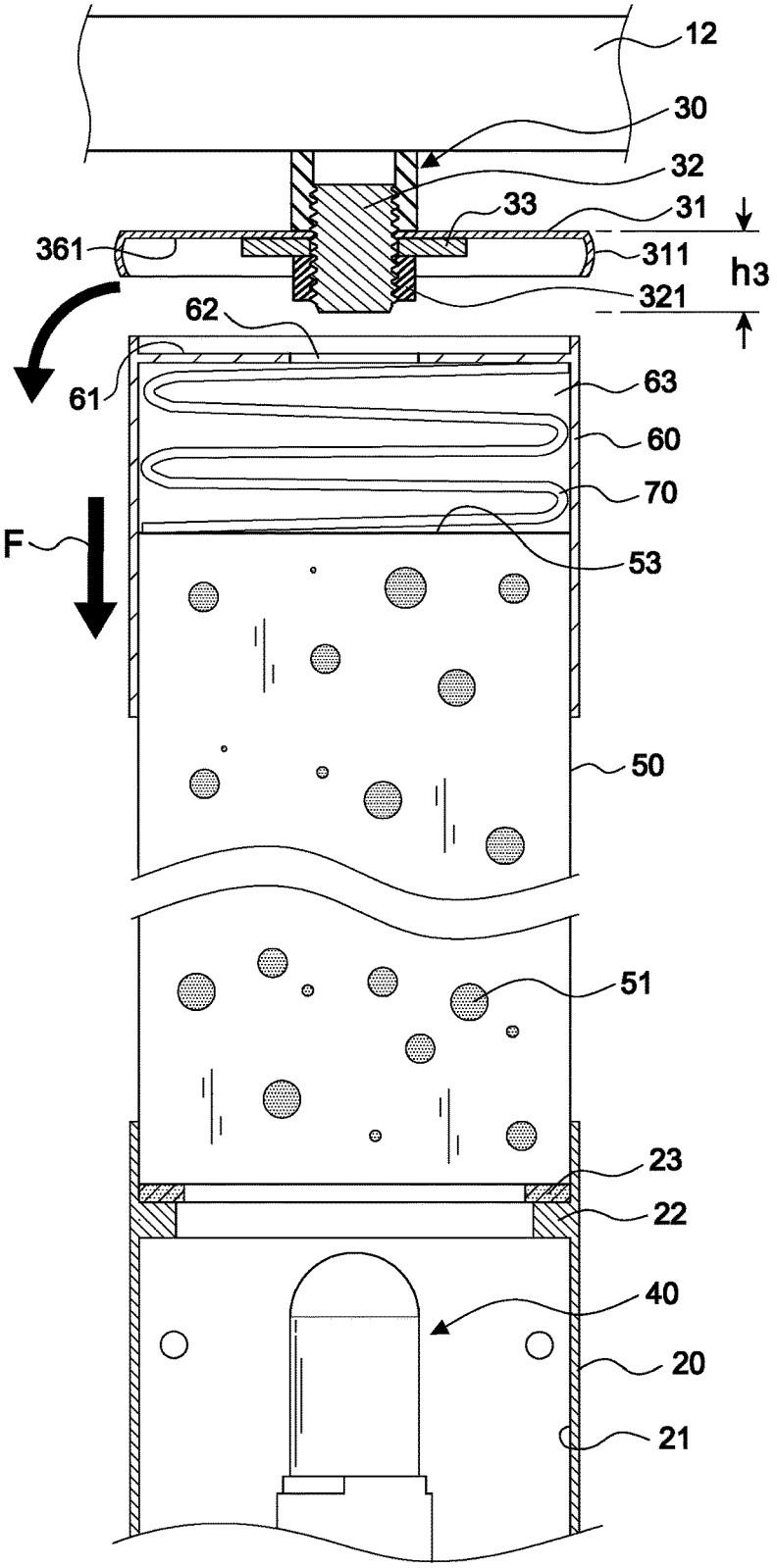
FIG. 7 is a sectional view of the present invention illustrating an assembling element thereof being disengaged.
Figure 8:
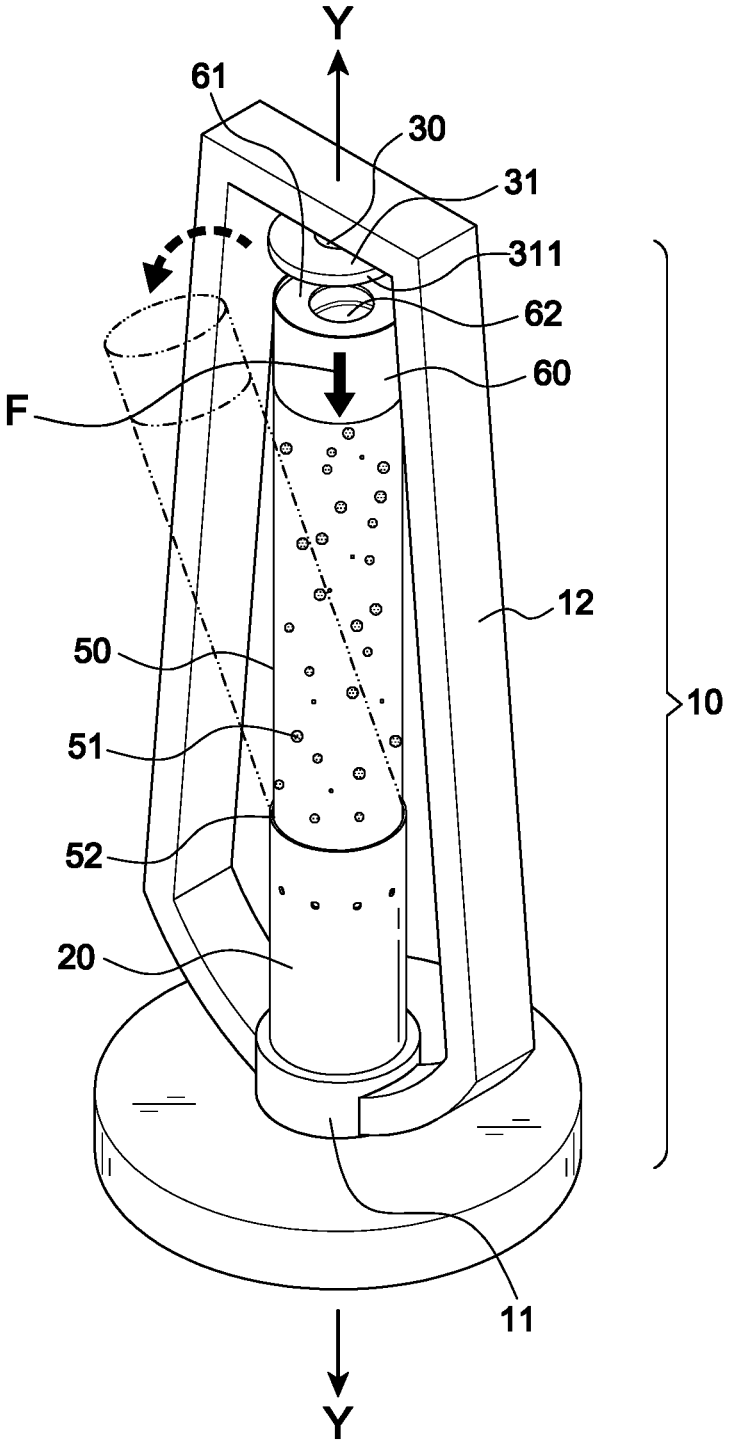
FIG. 8 is a schematic diagram illustrating the transparent bottle disengaged from the present invention.

On the other hand, the disengagement of the transparent bottle 50 is illustrated in FIGS. 7 and 8 for replacement of the transparent bottle 50 and the projection device 40. Firstly, pressing the assembling element 60 downwards F along the axis Y-Y to compress the spring 70 in the upper engaging space 63, and then the top surface 61 and the positioning hole 62 would be disengaged from the peripheral wall 311 of the positioning plate 31 and the engaging section 32; in other words, when the compression range is wider than a distance h3 composing the thickness of the positioning plate 31 and the protrusion length of the engaging section 32, the assembling element 60 is disengaged from the upper fixing element 30. Then the transparent bottle 50 can be disengaged from the lower fixing element 20 with slightly slanting. Such structure allows convenient replacement of the transparent bottle 50 and the projection device 40 anytime by anyone.

Figure 9:
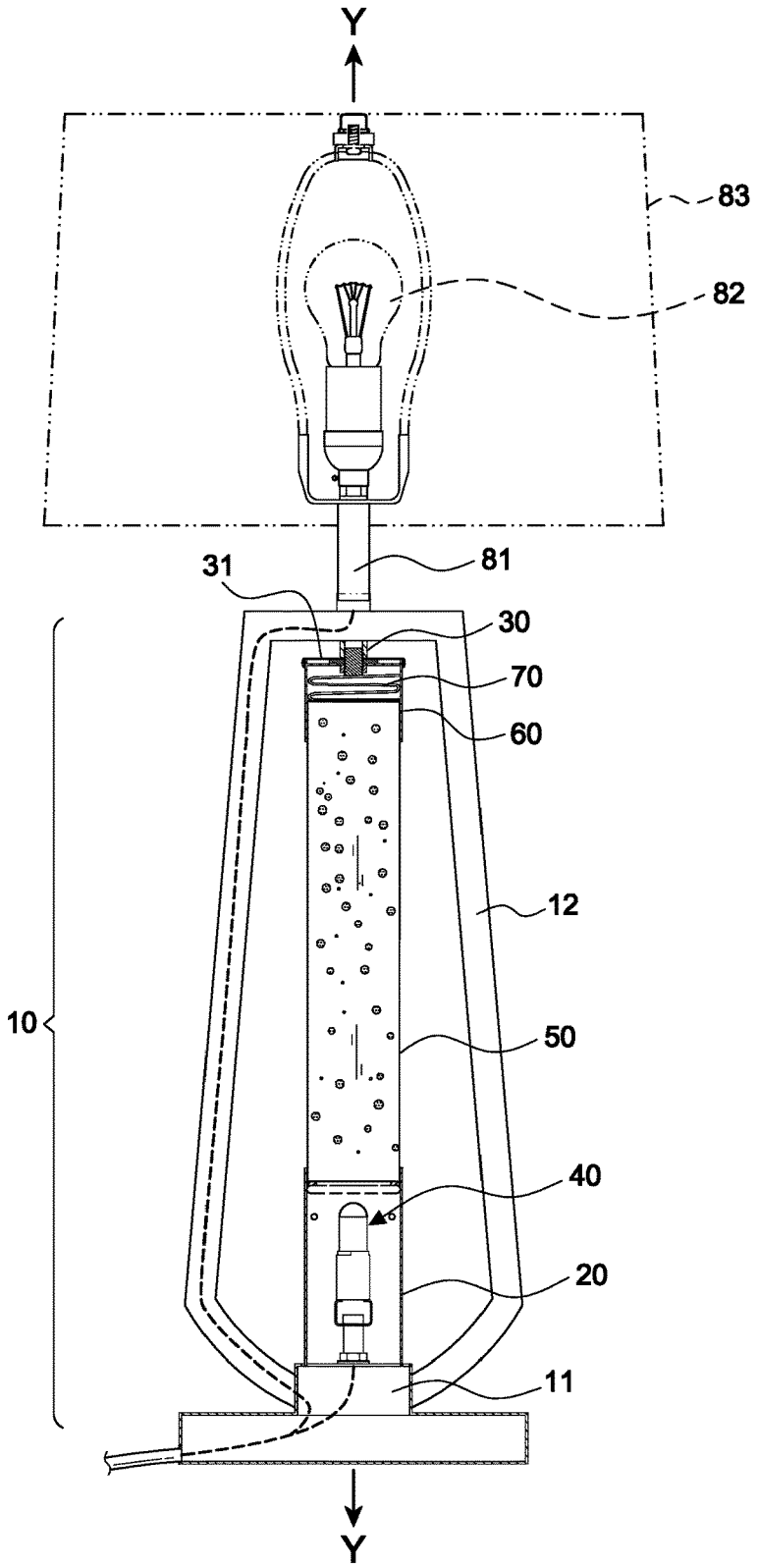
FIG. 9 is a perspective view of the present invention in another embodiment.

In FIG. 9, there is another embodiment of the present invention. The present invention further comprises a second bulb holder 81 and a lampshade 83 disposed on the stand 12 and the upper fixing element 30, and the second bulb holder 81 engages a lighting bulb 82. The present invention therefore has another practical function of lighting.

As stated, the present invention can easily disengage the assembling element 60 from the upper fixing element 30 within a slight compression distance of the spring 70; it can also fixedly place the transparent bottle 50 between the upper fixing element 30 and the lower fixing element 20 in case of unexpected or inadvertently shaking or moving, thus ensuring more stability and safety. With such structures, the present invention has less prime cost in the manufacturing process as well.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An improved structure of a lighting display device, comprising:

a frame body including a base at a bottom thereof, a stand connecting the base with a lower end thereof, an upper fixing element connecting with an upper end of the stand along an axis perpendicular to a center of the base and having a positioning plate, the positioning plate including a peripheral wall extending downwards to form a depression surface and an engaging section fixed at a center thereof, and a lower fixing element fixed on the base, defining a lower engaging space therein with a positioning annulus arranged on an inner surface thereof;

a projection device disposed within the lower engaging space;

a transparent bottle engaging the positioning annulus;

wherein an assembling element is mounted on the transparent bottle, having an upper engaging space therein and a top surface thereof engaging said depression surface of the positioning plate, the top surface having a positioning hole at a center thereof to engage the engaging section of the positioning plate for a stronger engagement therebetween; and wherein a spring is disposed inside the upper engaging space, abutting between the top surface of the assembling element and the transparent bottle for the transparent bottle to be positioned along the axis perpendicular to the base and for the top surface of the assembling element to fixedly engage the depression surface of the positioning plate;

whereby the transparent bottle would produce attractive visual effects by the projection device, and the spring allows the transparent bottle together with the assembling element to be easily engaged and disengaged from the upper and lower fixing elements.

2. The improved structure of a lighting display device as claimed in claim 1, wherein the top surface of the assembling element is either a flat surface or a concave surface.

3. The improved structure of a lighting display device as claimed in claim 1, wherein the positioning plate is detachable from the engaging section and includes a through hole at a center thereof, and the engaging section is extended from a bottom of the upper fixing element with threads formed on a periphery thereof for engaging through the through hole of the positioning plate and fixed under the bottom of the upper fixing element by a nut.

4. The improved structure of a lighting display device as claimed in claim 3, wherein a washer is further disposed between the nut and the positioning plate.

5. The improved structure of a lighting display device as claimed in claim 1, wherein a bumper pad is further disposed between the transparent bottle and the positioning annulus of the lower fixing element.

6. The improved structure of a lighting display device as claimed in claim 1, wherein the transparent bottle has fillers therein.

7. The improved structure of a lighting display device as claimed in claim 1, wherein the projection device includes a first bulb holder fixedly disposed in the lower engaging space of the lower fixing element and a bulb engaging on the first bulb holder for lighting and projection.

8. The improved structure of a lighting display device as claimed in claim 1, further comprising a second bulb holder and a lampshade disposed on the stand, and the second bulb holder engages a lighting bulb.

* * * * *